US012115417B2

(12) United States Patent
Norris

(10) Patent No.: US 12,115,417 B2
(45) Date of Patent: Oct. 15, 2024

(54) UNIVERSAL EXERCISE MACHINE WITH MOTORIZED RESISTANCE AND ASSOCIATED METHOD OF USE

(71) Applicant: Joshua Norris, St. Louis, MO (US)

(72) Inventor: Joshua Norris, St. Louis, MO (US)

( * ) Notice: Subject to any disclaimer, the term of this patent is extended or adjusted under 35 U.S.C. 154(b) by 198 days.

(21) Appl. No.: 17/626,933

(22) PCT Filed: Jul. 14, 2020

(86) PCT No.: PCT/US2020/041973
§ 371 (c)(1),
(2) Date: Jan. 13, 2022

(87) PCT Pub. No.: WO2021/011563
PCT Pub. Date: Jan. 21, 2021

(65) Prior Publication Data

US 2022/0258006 A1 Aug. 18, 2022

Related U.S. Application Data

(60) Provisional application No. 62/875,389, filed on Jul. 17, 2019.

(51) Int. Cl.
*A63B 24/00* (2006.01)
*A63B 21/005* (2006.01)
(Continued)

(52) U.S. Cl.
CPC ..... *A63B 24/0087* (2013.01); *A63B 21/0058* (2013.01); *A63B 22/025* (2015.10); *A63B 23/03566* (2013.01); *A63B 2225/10* (2013.01)

(58) Field of Classification Search
CPC ..... A63B 24/0087; A63B 21/0058; A63B 21/4035; A63B 21/4043; A63B 21/15; A63B 21/151; A63B 21/153; A63B 22/025; A63B 22/0242; A63B 22/02–0292; A63B 23/03516; A63B 23/03558–03566; A63B 2225/09; A63B 2225/15; A63B 2225/50; A63B 2225/10–102; A63B 71/0036; A63B 71/0622; A63B 2071/065; A63B 2071/0675; A63B 2210/50; A63B 2220/30; A63B 2220/51; A63B 2220/80; A63B 2220/833; A63B 2244/09
See application file for complete search history.

(56) References Cited

U.S. PATENT DOCUMENTS 5,409,435 A * 4/1995 Daniels ..... F16D 57/002 482/901
5,527,245 A * 6/1996 Dalebout ..... A63B 21/154 482/54

(Continued)

*Primary Examiner* — Loan B Jimenez
*Assistant Examiner* — Kathleen M Fisk
(74) *Attorney, Agent, or Firm* — Thompson Coburn LLP

(57) ABSTRACT

An exercise machine including a motor assembly that provides both motor driven resistance forces and motor driven rotation forces. A frame of the machine assists a user in the performance of an exercise, and separates a treadmill portion of the machine from a weightlifting portion of the machine. The treadmill portion is driven by the motor driven rotation forces, and the weightlifting portion is driven by the motor driven resistance forces, thereby providing a universal machine that provides for performance of a plurality of exercises.

7 Claims, 7 Drawing Sheets

(51) Int. Cl.
*A63B 22/02* (2006.01)
*A63B 23/035* (2006.01)

(56) References Cited

U.S. PATENT DOCUMENTS

| | | | | |
|---|---|---|---|---|
| 8,007,409 | B2 * | 8/2011 | Ellis | A63B 21/0616 482/54 |
| 8,096,926 | B1 * | 1/2012 | Batca | A63B 21/156 482/99 |
| 8,333,681 | B2 * | 12/2012 | Schmidt | A63B 21/153 482/4 |
| 8,454,479 | B2 * | 6/2013 | Ellis | A63B 21/0616 482/54 |
| 10,363,451 | B2 * | 7/2019 | Porteros De Luz | A63B 24/0087 |
| 10,426,989 | B2 * | 10/2019 | Dalebout | A63B 21/0442 |
| 10,569,121 | B2 * | 2/2020 | Watterson | A63B 23/03558 |
| 10,668,320 | B2 * | 6/2020 | Watterson | A63B 23/03566 |
| 2004/0043873 | A1 * | 3/2004 | Wilkinson | A63B 21/00065 482/52 |
| 2007/0232463 | A1 | 10/2007 | Wu | |
| 2007/0287601 | A1 * | 12/2007 | Burck | A63B 22/02 482/54 |
| 2011/0082011 | A1 | 4/2011 | Ellis | |
| 2013/0303334 | A1 * | 11/2013 | Adhami | A63B 24/0087 482/4 |
| 2018/0154205 | A1 | 6/2018 | Watterson | |
| 2022/0409950 | A1 * | 12/2022 | Zhu | A63B 22/02 |

* cited by examiner

UNIVERSAL EXERCISE MACHINE WITH MOTORIZED RESISTANCE AND ASSOCIATED METHOD OF USE

CROSS-REFERENCE TO RELATED APPLICATIONS

This application is a National Stage application of PCT/US2020/041973, filed on Jul. 14, 2020, claiming the benefit of U.S. Provisional Application No. 62/875,389, filed Jul. 17, 2019, both of which are incorporated herein by reference in their entireties.

STATEMENT REGARDING FEDERALLY SPONSORED RESEARCH OR DEVELOPMENT

Not Applicable.

APPENDIX

Not Applicable.

BACKGROUND OF THE INVENTION

This invention relates generally to exercise equipment and, more particularly, to a universal exercise machine configured to provide for performance, by a user, of a plurality of exercises using a common motor assembly of the machine.

Conventional exercise equipment includes devices such as treadmills and weight machines. For example, conventional treadmills allow for running/walking at various speeds, and may be motorized and include handles and/or armrests for providing balance. Conventional weight machines comprise a stack of weights to be lifted by a user. The weights are coupled to a pulley-type system of the machine, wherein a pin is inserted into the desired weight plate so that a user lifts only the weights stacked above the pin. Handles that are attached to the pulley-type system and used for pulling the weights are typically attached to solid bars that typically move from one point near the base structure of the machine. Because of this limitation, there is a limited range of motion in which exercises can be performed—usually a pull-and-return movement, such as pulling the handle with the hands and bending the arms, and then straightening bent arms to return the weights to a rest position.

However, there is no universal exercise machine that includes both a treadmill and resistance weightlifting in one machine. Additionally, conventional equipment does not include a frame that is configured to incorporate detachable/repositionable elements such as various attachments (e.g., straps, blocks and the like) to assist a user in performing various exercise postures, such as yoga-type exercises, or postures for alternative weightlifting positions.

Accordingly, conventional systems do not offer to the consumer/user a total workout suite comprising both aerobic training (e.g., cardio) and strength training, and are not designed for workouts involving difficult yoga postures.

SUMMARY OF THE INVENTION

It is in view of the above problems that the present invention was developed. The invention is a universal exercise machine that includes a treadmill portion, a weight resistance portion, and a central frame that assists in the performing of exercise postures such as yoga poses and/or various weight lifting positions. The invention includes a central motor assembly that provides motorized functionality to each the treadmill portion and the weight resistance portion. Accordingly, the invention allows for a user to perform a variety of exercises via a single, convenient machine.

For example, the motor assembly is used to drive the treadmill belt at a desired speed, and also to provide a desired amount of resistance for weight training. Thus, the motor assembly may comprise various systems, including a motor driven resistance system in connection with the weight lifting aspects, and a translational system for the driving of the treadmill. Each of these systems may comprise a variety of clutches, differentials, pulleys, belts, flywheels, gears, gearboxes, and so on and so forth. Accordingly, the overall motor assembly provides for motion and/or resistance that allow for performing an all-inclusive workout.

For example, weight lifting is performed by way of a user pulling against the motor driven resistance system, such motor driven resistance system comprising associated cables, spools, clutches, differentials, gearboxes, supports, beams, pulleys, clips, hooks, bases, frames, wall mounts, and/or adjustable swing arms. The fully functional treadmill uses other translational components (e.g., clutches, differentials, gearboxes, belts, flywheels and the like) connected to the same motor assembly for providing motion for the treadmill belt.

The frame may be configured to receive various accessory attachments such as adjustable balance bars, pads, straps, hoops, handles, blocks, accessory attachments and clips for yoga mats, to facilitate the performance of various (e.g., difficult) yoga/exercise postures. For example, a user may use a block attachment to serve as a location upon which to place a lifted leg, in order to better target certain muscles.

This represents an improvement over conventional exercise equipment. Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENT

Figure 1:
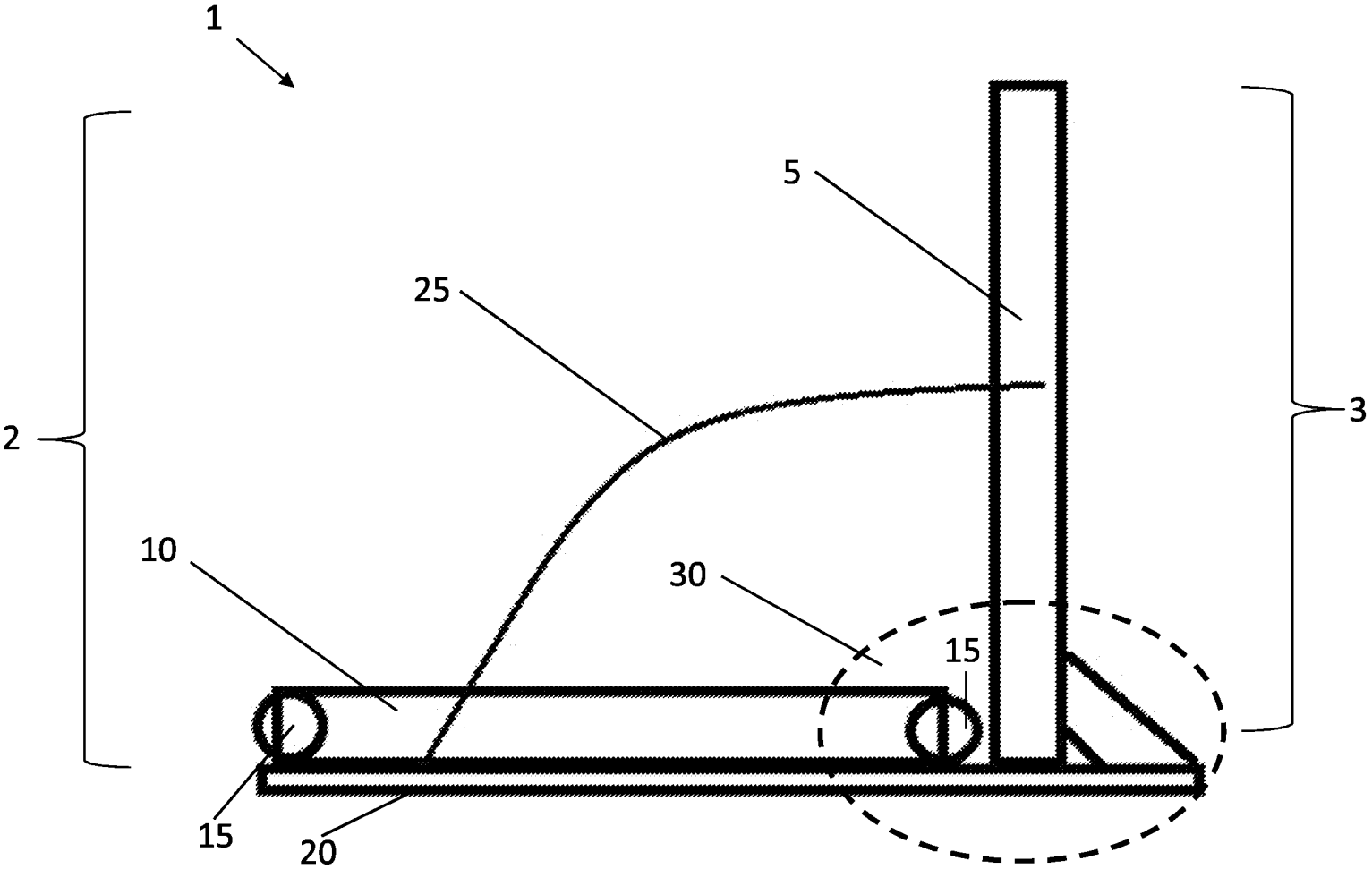
FIG. 1 illustrates a view of a preferred embodiment of the universal exercise machine according to the present invention.

Referring to the accompanying drawings in which like reference numbers indicate like elements, FIG. 1 illustrates one embodiment of a universal exercise machine 1. The machine 1 is universal in the sense that a central frame 5 of the machine 1 provides separation between a treadmill portion 2 of the machine 1 and a weight-training portion 3 of the machine. The frame 5 can be unitary in design, or include a second base at a lower portion thereof. For example, the second base may comprise the bottom end of the unitary frame itself, or be a separate base structure used in combination with the unitary frame.

As shown in FIG. 1, the treadmill portion 2 is proximate one side of the frame 5. The weight-training portion 3 is proximate a side of the frame 5 opposite to the side of the frame 5 that is proximate to the treadmill portion 2. Accordingly, the machine 1 provides for a user to perform both treadmill workouts and weight-training workouts. The treadmill portion 2 includes a treadmill 10, which comprises a first base of the machine 1. The treadmill 10 can include rollers 15 (and any associated hardware such as bolts, supports, etc.) and a belt (not shown) for the user to walk/run on. The machine 1 may include a support platform 20 that provides structural support for the overall machine, and that is in contact with the floor when the machine 1 is in a configuration for usage. A support bar/handle 25 can be connected to and span between a portion of the machine 1 that is on or near the treadmill 10 (such as the support platform 20) and a portion of the frame 5, for providing support to a user when using the treadmill 10. Space 30 shown within the dashed line in FIG. 1 indicates one preferred location of the motor assembly of the machine. The motor assembly, discussed in detail below, can provide driving force for the treadmill 10 and provide resistance for the weight-training portion 3 of the machine.

Figure 2:
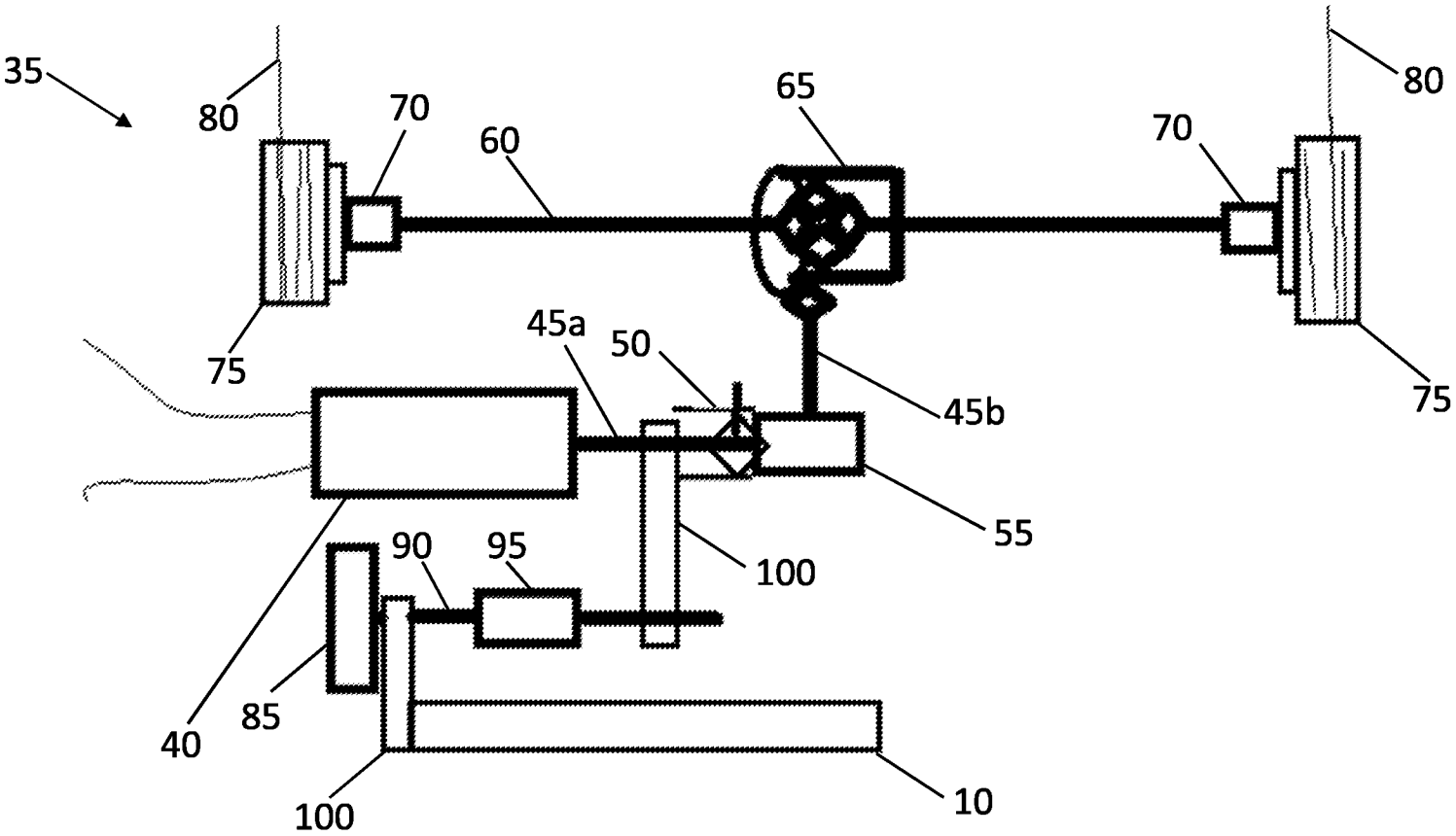
FIG. 2 illustrates motor components of the machine.

FIG. 2 illustrates the components of the motor assembly 35 to be accommodated in space 30. The motor assembly 35 may be housed in its own housing (not shown) and fixed between an end of the treadmill 10 and an end of the frame 5. The motor assembly 35 may instead be housed integrally in a portion of the treadmill 10 alone, or housed integrally within a portion of the frame 5 alone. Regardless of the particular arrangement and location of the motor assembly 35, the motor assembly 35 is capable of providing force for both the treadmill 10 and the weightlifting aspects of the machine 1.

As shown in FIG. 2, the motor assembly 35 includes a motor 40 (with lead wires shown), and translational components including main drive shafts 45*a* and 45*b*, a main clutch 50, and a main gearbox 55. The motor 40 may comprise any version of AC motor or DC motor, and be rated to a certain level of output with respect to horsepower, torque and/or RPM. For example, the motor 40 may comprise a 4,000 to 8,000 RPM motor with 2.0 to 4.0 horsepower, although any ratings sufficient to provide desired operation and performance are envisioned. The motor 40 can have certain peak duty and continuous duty ratings, and a certain treadmill duty rating. The peak duty represents a peak horsepower that the motor can reach. The continuous duty represents how much power is maintained throughout the workout. This continuous duty rating (aka continuous horsepower, CHP) may comprise 2.25 to 4.25 CHP. Treadmill duty represents the likely horsepower for an average user at an average speed over an average period of time. Nevertheless, because it is an average, it is not a true representation of power. The translational motion components 45*a*, 45*b*, 50 and 55 may be used in combination with the motor 40 to translate the motion of the motor 40.

The translational components for providing resistance for the weightlifting side 3 (shown in FIG. 1), include drive shaft 60, a differential 65, and clutches 70 for translating the motion of the motor 40. Spools 75 are located at ends of the drive shaft 60, and serve to hold wound cable 80 and are capable of rotation to wind/unwind the cable 80. The cable 80 is used as part of the weight-training portion 3 of the machine 1.

The translational components for providing motion for the treadmill 10 include a flywheel 85, a drive shaft 90, a gearbox 95, and belts and pulleys 100 for translating the motion of the motor 40. By way of the translation of the motor motion (aka translation of the motor forces) through the various components of the treadmill 10 and the weight lifting portion 3 (see FIG. 1), the motor assembly 35 is suited for driving both the treadmill 10 and for serving as a resistance system for weightlifting exercises.

Figure 3:
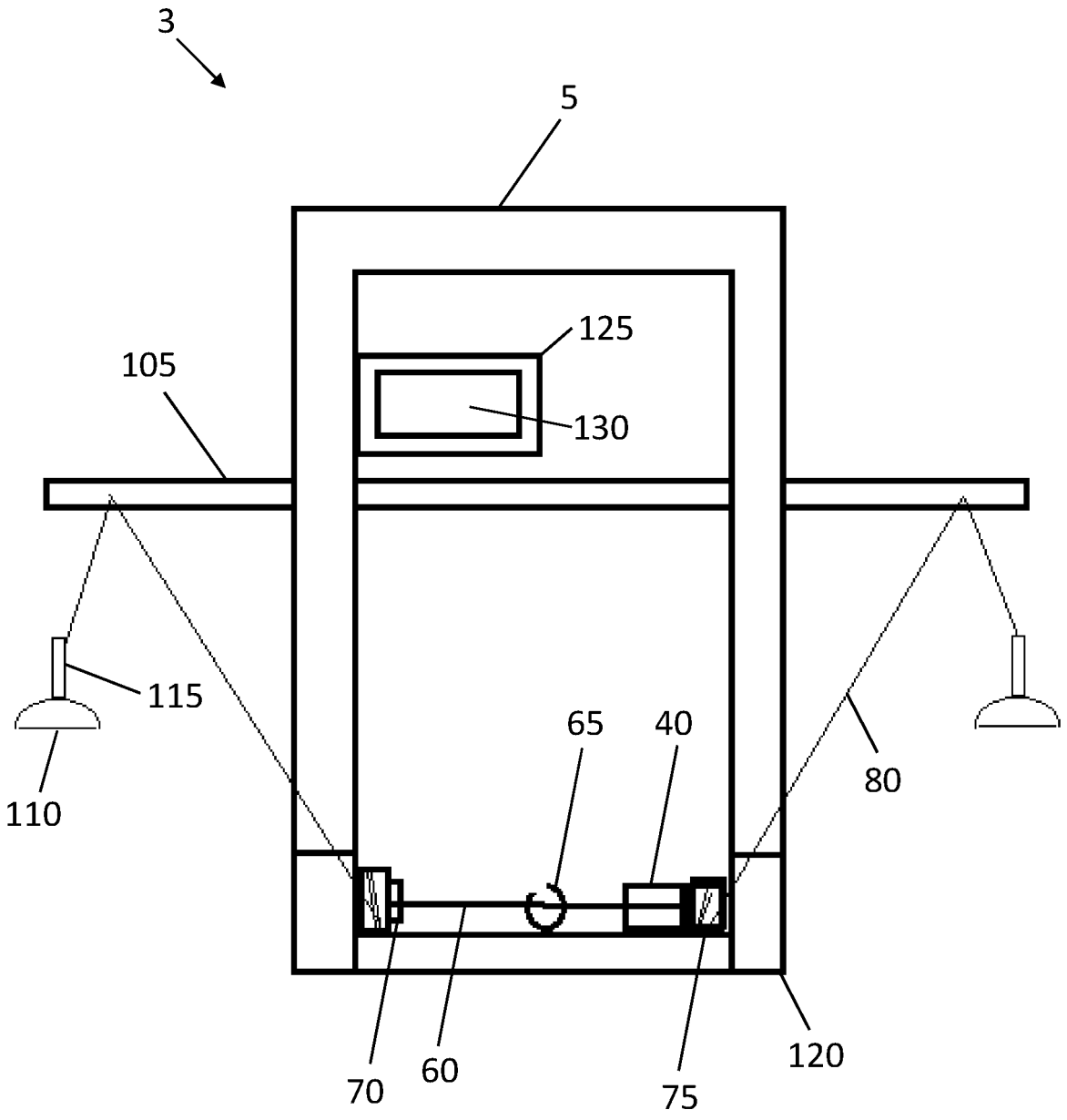
FIG. 3 illustrates one embodiment of the weight lifting side of the machine.

Further regarding the features of the weight resistance side 3, FIG. 3 illustrates a front view of the frame 5 according to one embodiment where a cable management system of the weight-training portion 3 comprises an adjustable bar 105 comprising, for example, clips and pulleys (not shown) that are used to hold cables 80. As shown, the cables 80 that extend from the spools 75 of the motor assembly 35 may be attached at respective ends of the bar 105, so as to provide for particular workout configurations. Handle(s) 110 and an enhancer 115 may be connected to the cables 80 to allow for pulling/releasing of the cables 80 by the user. The enhancer 115 may comprise a secondary grip to provide for alternative gripping as compared to that of the handle, or may be a form of strain relief that improves motion of the handle with respect to the cable 80 and/or reduces strain on the cable 80 at a cable-to-handle junction. For example, the strain relief may comprise plastic molding or the like, or the enhancer 115 may be configured as a swivel or the like, allowing for effectively total rotation of the handle(s) 110. For example, one end of the cable 80 can be connected to one side of the swivel portion of the enhancer 115, and the other end of the swivel portion of the enhancer 115 may include an adapter (not shown) that mates with a corresponding structure (not shown) of the handle(s) 110, thereby allowing freedom of motion of the handle(s) 110. The enhancer 115 may be configured to allow for the handle(s) 110 to be swapped out with alternative gripping elements such as a bar or the like (not shown). Thus, the enhancer 115 may include a mechanism that allows for the swapping of the handle(s) 110 to an alternative grip apparatus such as a bar. Such mechanism may include a snap-in assembly or other similar mechanism that allows for hot-swapping of handles/bars for performance of different exercises. As discussed above, the frame 5 may be coupled with a separate (e.g., second) base structure 120 used in combination with the unitary frame 5. This base 120 may house or otherwise support all or portions of the motor assembly 35.

Also shown in FIG. 3 is the computer 125 of the machine 1, which is mounted to the frame 5. The computer 125 may comprise an all-in-one type of computer, in which a single housing stores both a display 130 and the corresponding computer hardware (e.g., circuit boards, circuit components, hard drives and/or other memories, etc., not shown). The computer 125 may also include a built-in camera, and/or optical scanner (e.g., barcode reader) for the scanning of barcodes or the like that may be printed on accessories designed for use with the machine 1. This display 130 can be used to convey various audiovisual information to the user. The computer 125 can be electrically (e.g., via physical wires) or wirelessly connected to other functional aspects of the machine 1. Such functional aspects may include various control buttons (not shown) and/or user interfaces (not shown) that may be located at various locations of the machine 1. Physical buttons or touchscreens may be used to allow for user input and control/interaction with the machine 1. For example, the treadmill side 2 may be equipped with a central control panel (not shown) that allows for the user to set a desired pace, desired incline, or other treadmill functions. The incline functionality is preferably performed by a motor and translational components different from that of the motor assembly 35. Similar to the panel for the treadmill, there may be a central interface on the weight-training side 3 of the machine 1 that provides for selection of the desired weight-lifting parameters (e.g., setting of a desired level of resistance). Alternatively, the display 130 of the computer 125 may be used as a centralized interface for control of all of the aspects of the entire machine 1.

The computer 125 includes an electronic controller (not shown) used to control the motor 40. The controller can comprise an integrated circuit or the like that is configured to control devices such as motors. The controller can be located on a motor control circuit board (not shown) or motor control section of a circuit (not shown) of the computer 125. Such control of the motor 40 via the controller includes the controller outputting control signals to rotate the motor 40 at the desired rotation. For example, the control may include servo control concepts and/or pulse-width modulation (PWM) control. The controller may be a PWM controller. The PWM signal sent to the motor 40 determines positions of the drive shafts 45*a*/45*b*, and based on the duration of the pulse (sent, e.g., via a control wire), a rotor of the motor 40 will turn to the desired position.

Figure 4:
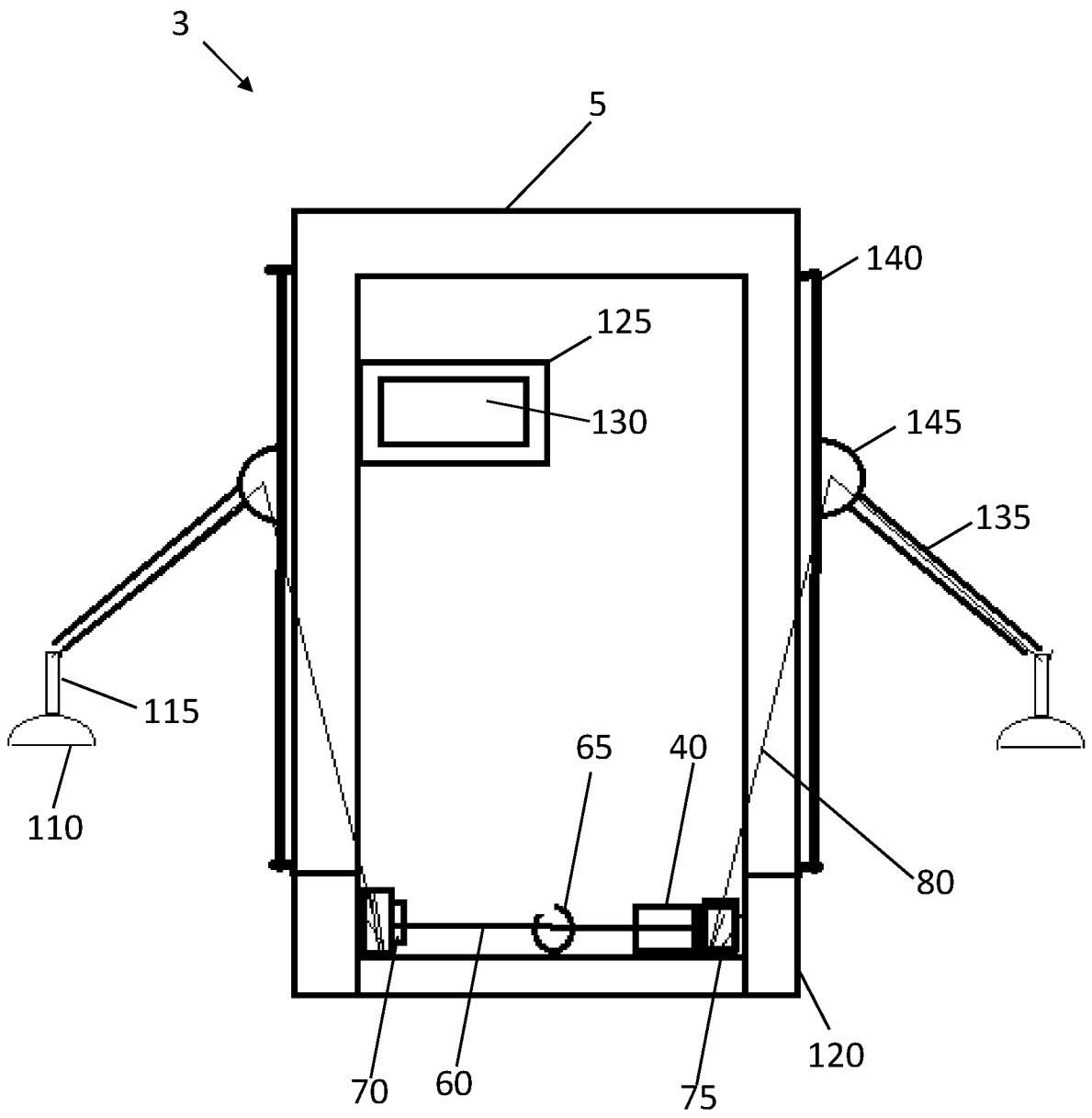
FIG. 4 illustrates an alternative embodiment of the weight lifting side of the machine.

FIG. 4 shows an alternative embodiment of a cable management system of the weight-lifting portion 3 of the machine 1, in which adjustable swing arms 135 are provided at each side of the frame 5 rather than the bar 105 shown in FIG. 3. The arms 135 may cooperate with a structure 140 that is attached to the frame 5, such structure 140 including, for example, a track for sliding the arms 135 up/down thereon. The arms 135 may further include a rotation-enabling structure 145 such as a ball joint so as to allow for circular motion of the arms 135. Such freedom of motion provided by the structure 140 and the rotation-enabling structure 145 allows a user to position their body and/or arms in a variety of weight-lifting positions when using the swing arms 135. The arms 135 may be able to be locked/unlocked into and out of certain positions via a locking mechanism (e.g., screw, knob, pin or the like) provided on the structure 140 and/or rotation-enabling structure 145. The arms 135 may be telescopic and therefore able to be extended to various lengths. There can be various locking positions (e.g., via a pin type locking mechanism) to lock the arms 135 at the desired length.

Figure 5:
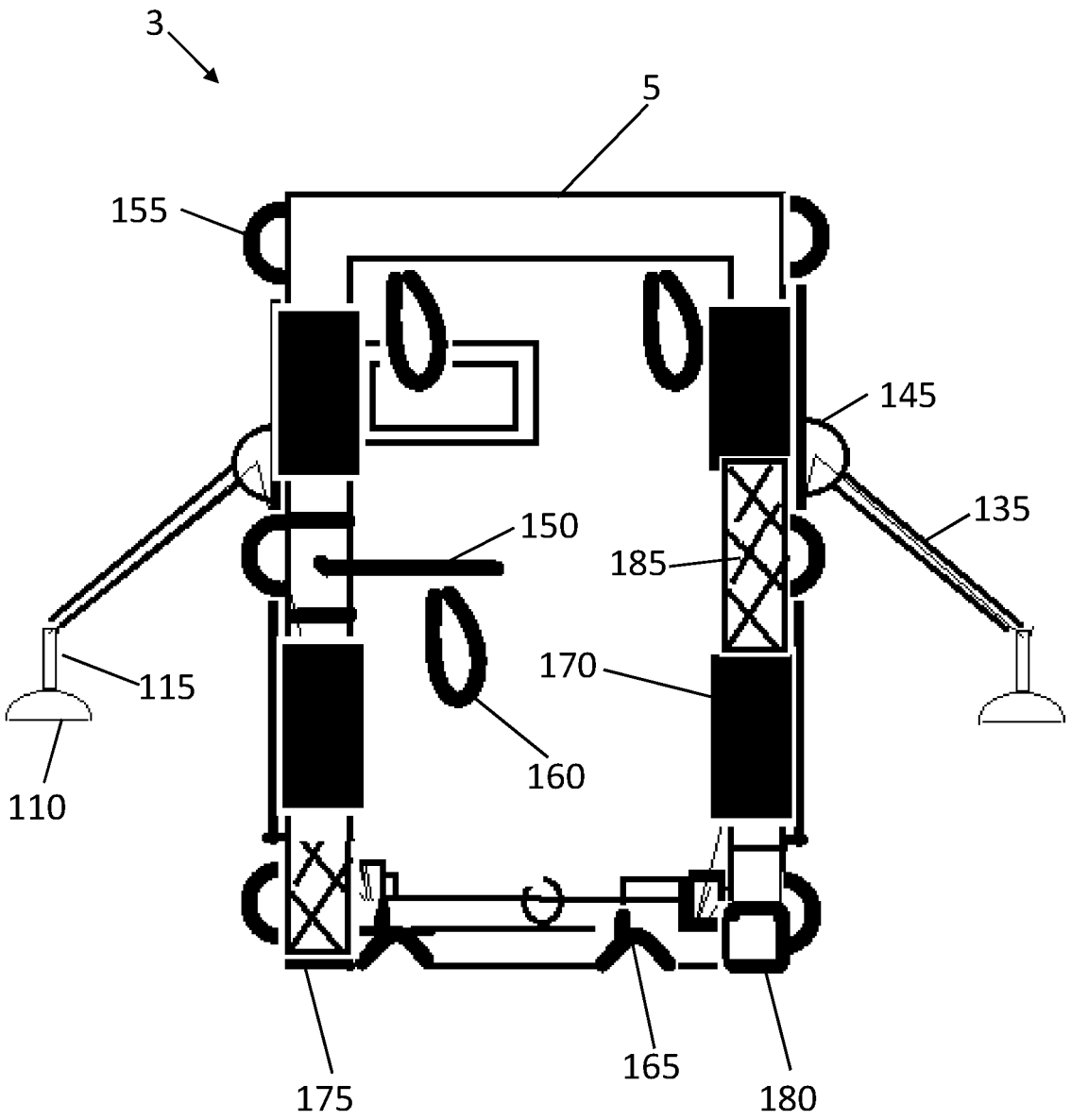
FIG. 5 illustrates various attachments that may be used in combination with the embodiments shown in FIGS. 3 and 4.
Figure 6:
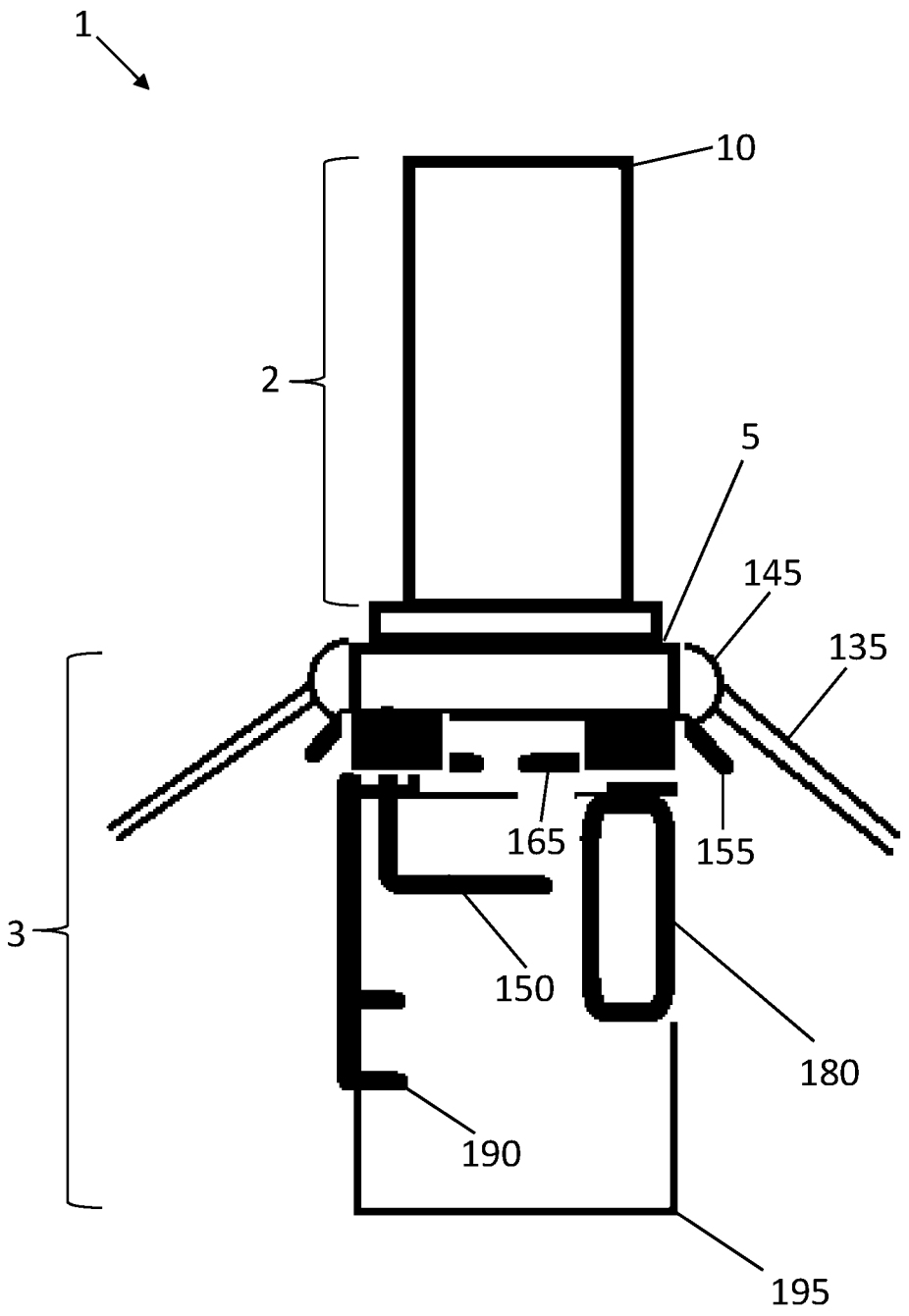
FIG. 6 illustrates a top view of the machine according to the embodiment shown in FIG. 5.

FIGS. 5 and 6 show how the portion 3, which is configured for weight resistance exercises, is configured to have a plurality of attachments connected thereto to facilitate performing a variety of additional exercises, poses, etc. While the configuration of FIGS. 5 and 6 is similar to that shown in the embodiment of FIG. 4, the attachments shown in FIGS. 5 and 6 can likewise be used in the embodiment shown in FIG. 3.

When a user is using the weight lifting system 3 of the machine 1, the frame 5 may be modified by attaching the plurality of attachments that are shown in FIG. 5. The attachments include but are not limited to an adjustable balance bar 150 that is capable of re-orientation, auxiliary handle(s) 155 that are adjustable to varying angles, hoops 160, straps 165, pads 170, clips 175 for mats, blocks 180, and foot pedals 185 that are adjustable to varying angles. FIG. 6 shows a further accessory attachment 190 and an exercise mat 195. These attachments serve a variety of functions, including to assist a user's balance, hold a user's feet, provide a location for one leg or head balancing postures, provide secure footing, provide ease of reach, cushion hips or joints, raise the ground level, or attach to the user an accessory according to the user's desire. As shown in FIGS. 5 and 6, these attachments may be connected to various locations on the frame 5 (e.g., top, middle, bottom), thereby providing a vast amount of customizable configurations and personalized workouts. For example, block attachments 180 may be configured to provide a location for body parts to be placed thereon, to assist in the execution of difficult yoga poses. The frame 5 and attachments therefore create an environment that assists in postures taken by the user for lifting weights, while providing a sturdy, safe foundation. Such attachments may come included with the machine 1, or be made available for separate purchase as add-ons to the base machine 1. Thus, a user/consumer can purchase only the attachments in which they have an interest.

The attachments may be configured with a mounting structure that mates with or is otherwise compatible with a mounting structure of the frame 5. For example, the frame 5 may comprise hooks (not shown), whereas the attachments may comprise latches for latching onto the hooks, thereby securing the attachment to the frame. The frame 5 may instead comprise threaded holes (not shown) for receiving threaded fasteners of the attachments. Any suitable male/female-type connection scheme may be used. The frame 5 and attachments may also comprise mating electrical contacts that can transmit signals therebetween. For example, the attachments may have identifying information (e.g., stored via RFID tag) such that the computer 125 can recognize which attachments are plugged into the frame 5 and recommend a set of exercises based on the inserted attachments. The attachments may also (or alternatively) comprise a barcode-type label that can be scanned by the reader/scanner of the computer 125, such that the computer 125 knows which attachments are being used and can recommend corresponding workouts based on the recognized attachment. The attachments may be able to be mounted in a variety of orientations, thereby providing for a corresponding variety of exercise maneuvers based on the orientation of the attachments. The frame 5 and attachments may comprise a keyed feature so as to ensure correction insertion of the attachments into the frame 5. For example, a receiving hole (not shown) of the frame 5 may comprise a shape that matches a shape of an insertion end of the attachment, such that there is only one possible manner in which the attachment can be inserted into the frame 5. The attachments may be configured as smart attachments that include electronics therein for capturing and sharing of information regarding usage of the attachments.

Wireless communication and/or position detection may be used in place of or in addition to any physical electrical contact between the attachments and the frame 5 and/or in conjunction with any of the electronics of the machine 1. When used herein, the term "wireless" and the phrase "wireless communication" include, but are not limited to, protocols/standards such as Bluetooth, WiFi, NFC, Zigbee, Z-wave or the like.

Referring back to FIG. 6, this figure shows a top view of the machine 1 according to the embodiment shown in FIG. 5. The attachments may be configured to provide a leverage point for a user to position their arm(s) or leg(s) when performing yoga or resistance weight training. The attachments may be placed at varying heights on the frame 5, so as to allow for a variety of exercises to be performed. Similar to the attachments, the cables 80 (see FIG. 5) may be oriented in different positions to allow for performance of a plurality workouts with varying levels of difficulty based, for example, on the amount of resistance provided via the motor components of the weight-training section 3.

Figure 7:
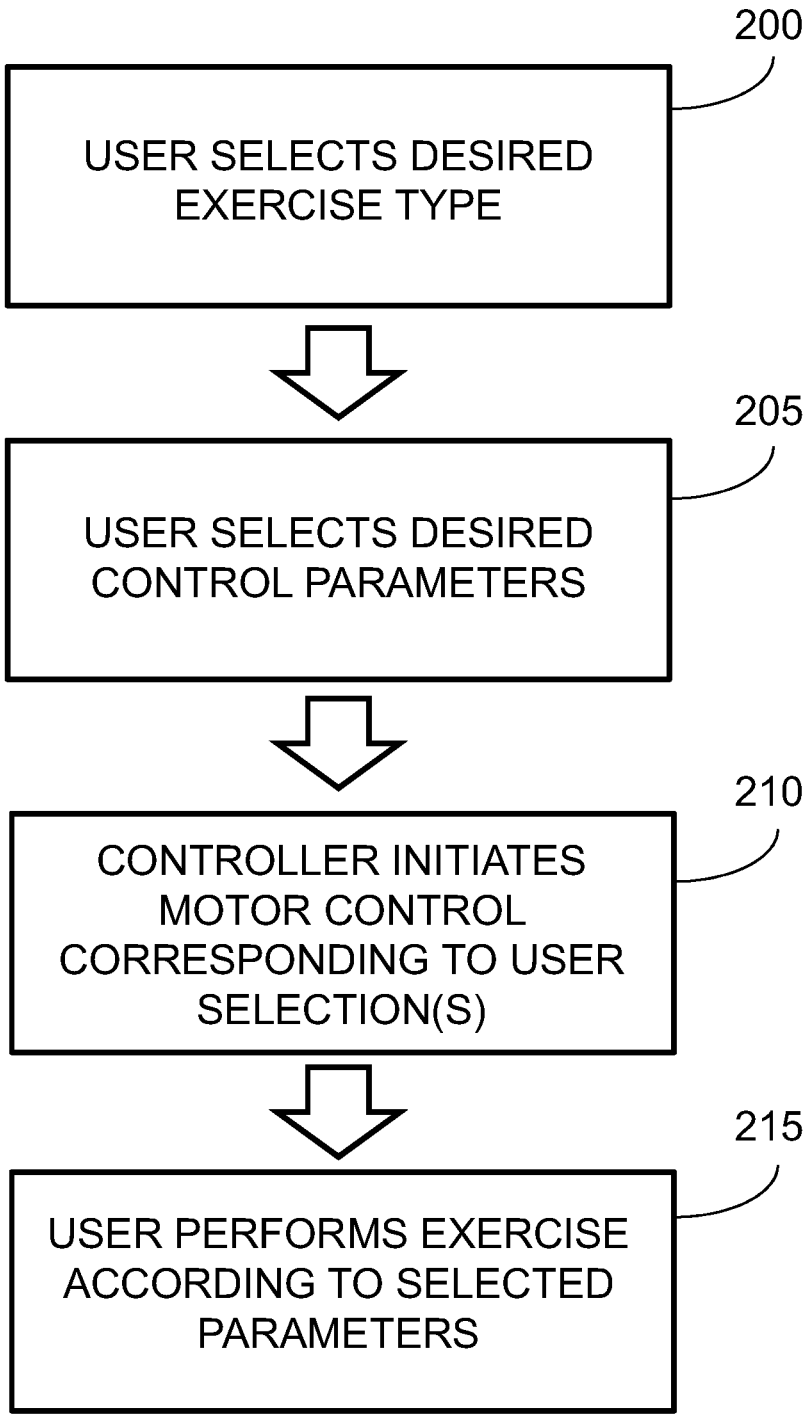
FIG. 7 illustrates a preferred method of performing using the universal exercise machine according to the present invention.

An example of an intended usage of the machine 1 is illustrated in FIG. 7 (in addition to FIGS. 3 and 4). For example, as shown in FIG. 7 at step 200, a user selects the desired exercise type. This includes selecting between using the treadmill portion 2, the weight-lifting portion 3, or using the frame 5 for yoga-type exercises. As represented by step 205, the user operates a control interface to provide the desired exercise parameters to the computer 125. Such parameters can include a desired treadmill speed, or a desired weight resistance level. The control interface may be a graphical user interface (GUI) of the display 130 of the machine 1, or a remote GUI on the user's mobile device (e.g., a user's personal mobile device may be paired with the machine so as to control and/or otherwise interact with the machine), or physical buttons of the machine 1. The computer 125 then issues control commands (e.g., control signals) to the electronic controller that is associated with the computer 125, so that the controller then at step 210 controls the motor 40 to operate at the selected speed/resistance level. At step 215, the user then selects the particular side of the machine 1 that they want to use based on the selected exercise (i.e., either the portion 3 for yoga/weightlifting or the treadmill portion 2 for running/walking) and performs the exercise. In the case of performing yoga poses on portion 3 of the machine 1, it may be the case that the user does not input any parameters into the computer 125, and merely chooses to perform yoga without any electronic assistance/tracking.

With respect to using the treadmill 10 of the universal machine 1, the motor assembly 35 may be configured to seta pace of walking at 10 MPH (e.g., with the motor 40 running at 2 CHP), a running pace at 12 MPH (e.g., with the motor 40 running at 3.0 CHP), or jogging pace at an MPH between that of walking and running (e.g., with the motor 40 running at 2.5 CHP). Such levels will vary depending upon the user. For example, user weight and workout intensity both increase CHP demand. However, the arrangement of the translational components with respect to the motor driving resistance system for weight-training section 3 is different than that of the arrangement of the translational components for use of the treadmill section 2 (e.g., differences can be with respect to driving the roller(s) 15 of treadmill 10 via the treadmill flywheel 85 and pulleys/belts 100 versus using the differential 65 for driving the spools 75 of the weight-training system).

With respect to using the weight resistance system 3 of the machine 1, in operation, the user uses the control interface of the machine 1 to set the motor driven resistance system to the desired level, which causes the computer 125 to send control signals to the electronic controller associated with the computer to control the motor driven resistance system (i.e., to set the desired resistance level). The drive shaft 60 is operatively coupled to the spool(s) 75 to provide for rotation of the spool(s) 75. While the various translational components (e.g., gearbox, differential, clutches, etc.) can be adjusted manually, ideally the controller is used for most adjustments to such components. When the user intends to lift weights or perform yoga-like postures, the user can adjust the above-noted attachments to assist in such exercises. For weightlifting, the user pulls on the handle(s) 110, and the motor 40 pulls back, thereby providing resistance for resistance weight training. For example, the motor can be configured to provide 200 lbs. of resistance, although higher resistance amounts are envisioned (e.g., by using a motor capable of providing more resistance force). Accordingly, the weight resistance system 3 can replace conventional bulky metal or filled plastic weights, thereby reducing weight of the universal machine 1 and allowing for a more compact size. The motor 40 can be deactivated until the user is in position to perform the desired weight training. Then the motor 40 can be activated so as to allow for performance of the workout. Such activation/deactivation can be by way of a physical button, or a button on a digital GUI, or by voice control using such voice control applications such as Amazon's "Alexa" or Apple's "Siri."

Additional aspects of the present invention are as follows.

The frame 5 is preferably a metal frame, although other suitable materials are possible. The frame 5 may be collapsible for storage and/or space-saving measures. Accordingly, a variety of hinges (not shown) can be provided at various locations of the machine 1 to allow for collapsing of the machine 1 into a smaller profile (e.g., for easier transport and/or improved storage). For example, the frame 5 may be configured to rotate about a hinge or a central axis that corresponds to the motor rotation. In this regard, the motor components may further include a dedicated linkage assembly to provide for motorized assistance in collapsing/raising the frame 5 from a stowed/deployed state. The machine 1 may also include wheels (not shown) to allow for transport. Such wheels may be able to be stowed and/or locked to preclude rotation of the wheels when rotation is not desired.

The motor 40 may be mounted to the frame 5, and connected to the various translational components (e.g., gearbox, differential, clutches, etc.). Depending on the configuration, the cable(s) 80 used with the weight-training system 3 is/are guided by the spools 75 and the adjustable bar 105 or adjustable swing arms 135. The user interacts with the cable(s) 80 through the handle(s) 110 and/or the enhancer 115. The cables 80 can be made of strands of steel or the like, and may comprise a data wire (not shown) running for communication with the computer 125 (e.g., for transmission of sensed data (e.g., force data, retraction data, etc.)). Such a data wire may be used in conjunction with a sensor. The action of the motor 40 and the user experience is controlled by the computer 125 and associated controller. When the treadmill 10 is being used, the motor 40 may compensate for the weight of the user so as to maintain the desired speed setting. Instead of one motor 40, a plurality of motors can be used if so desired.

The exercise machine 1 may be configured as a smart-home device, such that usage can be tracked. For example, the machine 1 may be configured to track on/off status, duration of usage, etc. Moreover, the machine 1 may be configured to support different user profiles, such that individualized settings are automatically loaded and/or initiated based on an event such as a user logging in, or use of a fingerprint scanner or similar identifying mechanism (e.g., face-scanning) for identifying individuals. As such, the machine 1 may include a scanner/reader/camera for interacting with external objects. For example, if the machine 1 according to the present invention were to be used by two workout partners, one user profile and corresponding resistance level may be triggered upon the login of one workout partner, whereas a different resistance level may be automatically set upon login of the other workout partner. Thus, custom user profiles are envisioned.

Artificial intelligence (AI) aspects may also be integrated into the machine 1. For example, the computer 125 of the machine 1 may include software that learns a user's patterns overtime (e.g., machine learning). Further, by way of such learning, the AI may be able to suggest new and/or different workouts. This may assist users in avoiding hitting a workout plateau and/or optimizing workouts for their particular body type.

By way of the universal design, the machine 1 serves as a workout station for two users to exercise together. For example, while one person is using the treadmill 10, the other can perform yoga on the portion 3 of the frame 5 opposite the treadmill 10 that includes the attachments as shown in FIGS. 5 and 6, thereby allowing for simultaneous workouts using the same machine. In an embodiment where the treadmill 10 and weight-lifting system 3 are driven by separate motors, then two users can use both motor-driven aspects of the machine 1. Thus, a plurality of motors may be used—e.g., one dedicated to the spool 75 and cable 80 components of the weight-training system 3 and another dedicated to the treadmill system 2.

The machine 1 can be configured to generate information about the user that can be stored, upgraded, or otherwise used and/or commercialized. The machine 1 can also display workout routines developed by independent third parties and sold to users and thus act as a median of exchange. The machine 1 can be used as a source of research for hospitals and physical therapists to produce data to share among colleagues or research institutions.

The computer 125 comprises sufficient computer hardware such as processors and memory to provide processing power and storage of data. The computer 125 may be configured with a traditional operating system and be preloaded with workout software. The machine 1 can be connected to a communications network using communication protocols including but not limited to LAN (e.g., WiFi), cellular (e.g., 5G), and satellite or the like. The machine 1 may be configured to display content from a subscription service and live-stream workout classes. The machine 1 is preferably powered by way of a power cord that plugs into conventional mains power (e.g., using a 15 or 20 amp circuit), although battery-powered or other alternative power schemes are contemplated.

The machine 1 may be equipped with a variety of sensors (not shown) for measuring speed (e.g., of the treadmill track), force, etc. These sensors may be integrated with the computer 125 of the machine 1 such that any sensed information can be transferred as sensed data that may be shared with the computer 125 for interpretation of the sensed data and usage of the interpreted data. Such usage may include suggestions to the user, and/or marketing/selling of such data. The sensors can include slip rings, weight sensors, gyroscopes, etc., and may be located at any location of the machine 1 to allow for acquisition of data. For example, the sensors may be integrated into the handle(s) 110 or bar 105 or any other location where it is desired to acquire data. A slip ring may be used to analyze pulling/retraction of the cables 80. With respect to smart-machine aspects, the acquired data can be transferred on the fly to allow for real-time adjustment of workouts, etc.

The screen of the display 130 may be a touchscreen and can be used to display (e.g., scripted) workout routines, play music, or provide information such as heartrate, workout duration, calories burned, etc. Such content can be subscription-based. The display 130 can be utilized as a progress tracker, timer, and so forth. Additionally, a smart-device such as a FitBit or similar health-monitoring wearable may be paired/synchronized to the computer 125 of the machine 1 such that a user is able to view and/or otherwise get updates during a workout session on the display 130. The computer 125 and/or display 130 may be configured to pair and/or otherwise receive audiovisual content streamed from an external device such as a smartphone. The screen of the display 130 may be configured to rotate about a central-axis, such that the display 130 can be rotated between a state in which it is visible during usage of the treadmill portion 2 and a state in which the user is using the resistance weight-training portion 3 of the machine 1. In an alternative embodiment, the display 130 may instead comprise a dock for a tablet or smartphone so that a user may use their own personalized device, with the tablet or smartphone then serving as the display. The unitary display housing may comprise two displays, one display being visible from the treadmill side 2 and the other visible from the weight-training/yoga side 3, such that when two users are using the machine 1 at the same time, each user can have a dedicated screen to view.

In view of the foregoing, it will be seen that the several advantages of the invention are achieved and attained.

The embodiments were chosen and described in order to explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An exercise machine, comprising:

a computer;

a first base;

a second base, wherein the second base is adjacent to the first base;

a motor assembly adjacent the first base and the second base, the motor assembly being controlled by the computer and being operatively coupled to translation components of each the first base and the second base, the motor assembly being adapted and configured to provide motorized output to the translation components of each the first base and the second base, the motor assembly having a resistance force;

a frame defining opposite facing first and second sides of the exercise machine;

wherein the first base extends from the first side of the frame, the first base comprises a treadmill, the motorized output of the motor assembly rotates a roller of the treadmill to drive the treadmill;

wherein a resistance weightlifting system extends from the second side of the frame, the resistance weightlifting system comprises a plurality of cables that are connected to the frame and operably connected to the motor assembly, the resistance weightlifting system is driven by the motor assembly and has a resistance corresponding to the resistance force of the motor assembly.

2. The exercise machine of claim 1, wherein the frame is configured to connect with a detachable attachment that detachably connects to the frame.

3. The exercise machine of claim 2, wherein the detachable attachment includes an attachment from a group of attachments comprising accessories, bars, handles, hoops, straps, pads, blocks, clips and pedals; the attachments being configured to facilitate performance of a plurality of exercises.

4. The exercise machine of claim 1, further comprising one of an adjustable bar or adjustable arms connected to the cables, wherein the adjustable arms are capable of movement in at least two planes.

5. The exercise machine of claim 1, further comprising handles attached to ends of the cables.

6. The exercise machine of claim 1, wherein the computer comprises a controller for controlling the motor assembly.

7. The exercise machine of claim 1, wherein the computer comprises a display for conveying information to a user.

* * * * *